US006196885B1

(12) United States Patent
Catalino, Jr. et al.

(10) Patent No.: US 6,196,885 B1
(45) Date of Patent: Mar. 6, 2001

(54) ELECTRICAL PLUG BLADES

(75) Inventors: William Catalino, Jr., Barnegat; Patrick M. Emmet, Lanoka Harbor; Michael Jerome, Toms River; Thomas A. Jerome, Barnegat, all of NJ (US)

(73) Assignee: Heyco Products, Inc., Toms River, NJ (US)

( * ) Notice: Subject to any disclaimer, the term of this patent is extended or adjusted under 35 U.S.C. 154(b) by 0 days.

(21) Appl. No.: 09/250,509

(22) Filed: Feb. 16, 1999

Related U.S. Application Data

(60) Provisional application No. 60/076,134, filed on Feb. 27, 1998.

(51) Int. Cl.[7] ..... H01R 4/10

(52) U.S. Cl. ..... 439/881; 439/883; 439/884; 439/885

(58) Field of Search ..... 439/881, 883, 439/884, 885

(56) References Cited

U.S. PATENT DOCUMENTS

| | | | | |
|---|---|---|---|---|
| 3,355,698 | * | 11/1967 | Keller | 339/97 |
| 3,470,529 | | 9/1969 | Klumpp, Jr. | 339/276 |
| 3,670,298 | | 6/1972 | Klumpp, Jr. | 339/276 |
| 3,861,779 | | 1/1975 | Pfeifer | 339/184 |
| 3,915,543 | | 10/1975 | Pfeifer | 339/189 |
| 5,176,545 | | 1/1993 | Brown | 439/885 |
| 5,217,388 | | 6/1993 | Brown | 439/455 |
| 5,556,308 | * | 9/1996 | Brown et al. | 439/746 |
| 5,662,484 | | 9/1997 | Blanche | 439/106 |
| 5,823,834 | * | 10/1998 | Straeb et al. | 439/884 |

* cited by examiner

*Primary Examiner*—Paula Bradley
*Assistant Examiner*—Alexander Gilman
(74) *Attorney, Agent, or Firm*—Selitto & Associates

(57) ABSTRACT

An electrical plug blade according to a first embodiment the invention includes a blade portion, a wire cradle, two crimp ears, and centering means for centering a stranded wire within the wire cradle. The centering means is preferably in the form of two centering nubs projecting above the base of the wire cradle. Another embodiment of the invention includes a padded range-style blade portion specifically designed for use in 30 to 60 ampere applications. This embodiment can be constructed both with and without the centering means in the wire cradle.

12 Claims, 1 Drawing Sheet

ELECTRICAL PLUG BLADES

CROSS REFERENCE TO RELATED APPLICATIONS

This is a §111(a) application relating to U.S. application Ser. No. 60/076,134 filed Feb. 27, 1998.

FIELD OF THE INVENTION

The present invention relates to electrical plug blades and, more particularly, to electrical plug blades of a padded and/or a non-padded type.

BACKGROUND OF THE INVENTION

The type of electrical plug blade wire crimp known in the art (as shown in FIG. 1) has a wire cradle with two outwardly extending crimp ears and a flat bottom surface on which a stranded wire lies. The stranded wire is often not centered between the crimp ears prior to crimping, leading to finished crimps that are either lop-sided or that have not captured all of the wire strands. Either of these imperfect crimps could lead to contact failure between the stranded wire and the plug blade and a potential failure of the Underwriters' Laboratories standard pull test, leading to overall plug failure and to a potentially hazardous electrical condition for the user.

There is presently a need for a wire crimp design that provides for improved wire termination and crimping, so as to avoid the problems of the prior art. There is also a need for a padded range-style electrical plug blade for use in 30 to 60 ampere applications, as the prior art is limited to padded electrical plug blades for use in 15 ampere applications. The embodiments of the present invention satisfy those needs.

SUMMARY OF THE INVENTION

One embodiment of the electrical plug blades of the present invention has a wire cradle with a base and two outwardly extending crimp ears, the improvement over the prior art being that there is a depression in the base of the wire cradle, which allows for easy and automatic self-centering of a wire within the wire cradle before crimping. The depression is created by a punch in the production die, which deforms the base of the wire cradle, creating two centering nubs, each of which is located adjacent to one of the crimp ears.

When a wire is laid in the wire cradle, it is automatically self-centered therein by the shape of the centering nubs, which slope downward toward the base of the wire cradle. The crimp ears can then be rolled around the wire, finishing the crimp and thereby firmly attaching the wire to the electrical plug blade.

In an another embodiment of the present invention, the electrical plug blade is of the padded range-style type, and is designed for use in applications from 30 to 60 amperes. This padded range-style electrical plug blade can be constructed either with or without the self-centering wire cradle described above.

BRIEF DESCRIPTION OF THE DRAWINGS

For a better understanding of the present invention, reference is made to the following detailed description of three exemplary embodiments considered in conjunction with the accompanying drawings, in which.

DETAILED DESCRIPTION OF THE INVENTION

Figure 1:
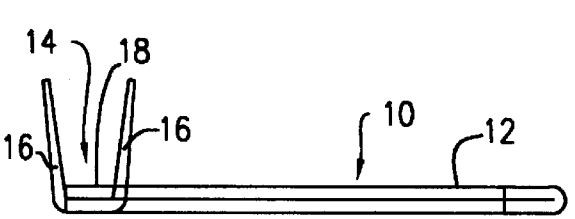
(PRIOR ART) FIG. 1
FIG. 1 is a side elevational view of an electrical plug blade typical of the prior art.

FIG. 1 shows a prior art electrical plug blade 10, with a blade portion 12 and a wire cradle 14, which is surrounded on two sides by outwardly extending crimp ears 16. As can be seen in FIG. 1, the wire cradle 14 has a flat base 18, which does not allow for the self-centering of a stranded wire between the crimp ears 16.

Figure 2:
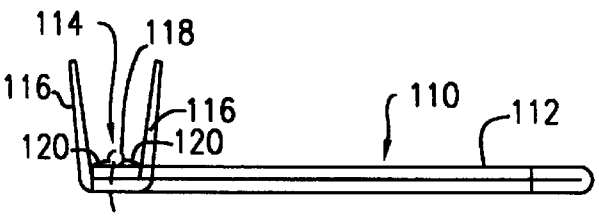
FIG. 2 is a side elevational view of a non-padded electrical plug blade constructed in accordance with one embodiment of the present invention.

FIG. 2 depicts an electrical plug blade equipped with a self-centering wire crimp and constructed in accordance with one embodiment of the present invention. To facilitate consideration and discussion, elements illustrated in FIG. 2 which correspond to the elements described above with respect to FIG. 1 have been designated by corresponding reference numerals increased by one hundred.

Referring now to FIG. 2, an electrical plug blade 110 is comprised of a blade portion 112 and a wire cradle 114, which is surrounded on two sides by outwardly extending crimp ears 116. A base 118 of the wire cradle 114 has two centering nubs 120, with each of the centering nubs 120 being located adjacent to one of the crimp ears 116. The centering nubs 120 are shaped such that regardless of where a stranded wire 121 (shown in phantom) is placed in the wire cradle 114, the stranded wire 121 will self-center in the wire cradle 114 between the two centering nubs 120.

The centering nubs 120 are formed by a punch as the plug blade 110 progresses through the production die. The section of the blade portion 112 that extends into the wire cradle 114 is deformed by the punch; there is no additional material used to create the centering nubs 120. The centering of the stranded wire 121 between the centering nubs 120 leads to improved overall crimping and termination of the stranded wire 121, thereby reducing the chances of encountering the existing problems of finished crimps that are either lop-sided or that have not captured all of the wire strands.

Figure 3:
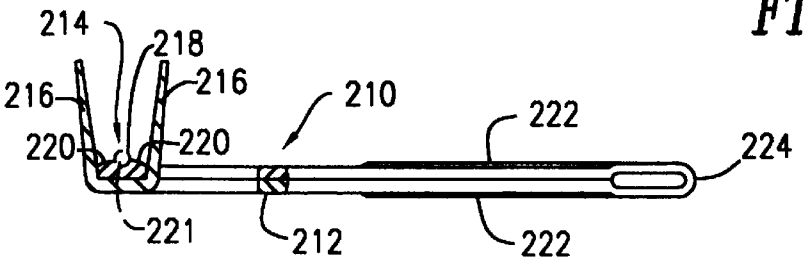
FIG. 3 is a partial cross-sectional, side elevational view of a padded electrical plug blade constructed in accordance with a second embodiment of the present invention.
Figure 4:
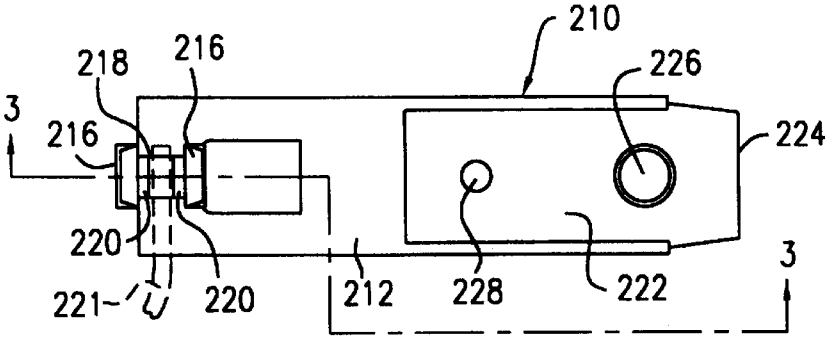
FIG. 4 is a top view of the embodiment shown in FIG. 3.
Figure 5:
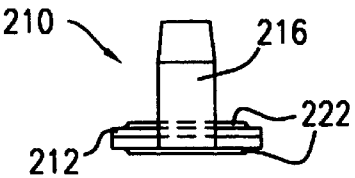
FIG. 5 is a rear elevational view of the embodiment shown in FIG. 3.

FIGS. 3, 4, and 5 illustrate a padded electrical plug blade equipped with a self-centering wire crimp and constructed in accordance with a second embodiment of the present invention. To facilitate consideration and discussion, elements illustrated in FIGS. 3, 4, and 5 which correspond to the elements described above with respect to FIG. 2 have been designated by corresponding reference numerals increased by one hundred. The embodiment of FIGS. 3, 4, and 5 is constructed and designed for use in the same manner as the embodiment of FIG. 2, unless otherwise stated.

Referring now to FIGS. 3, 4, and 5, an electrical plug blade 210 is comprised of a blade portion 212 and a wire cradle 214, with a section of the blade portion 212 having a pad 222 embossed into each side thereof. To maintain a uniform thickness along the length of the pads 222, the electrical plug blade 210 has a tip 224 with an open, oval-shaped cross-section (as can be seen in the side elevational view of FIG. 3). A pilot hole 226, extending completely through the electrical plug blade 210, is provided near the tip 224 as a guide for the production die. A dimple 228 is located on each of the pads 222, near the end of each pad 222 opposite the tip 224, to add strength to each pad 222, such that if the pads 222 are compressed, they will not be crushed by the compression force.

Figure 6:
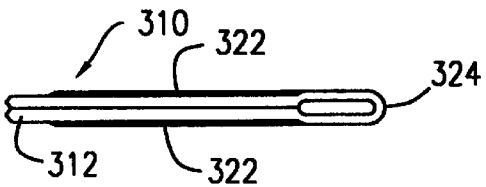
FIG. 6 is a partial side elevational view of a padded electrical plug blade constructed in accordance with a third embodiment of the present invention.
Figure 7:
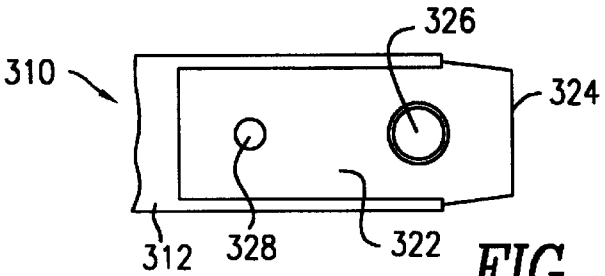
FIG. 7 is a partial top view of the embodiment shown in FIG. 6.

FIGS. 6 and 7 show a padded electrical plug blade constructed in accordance with a third embodiment of the present invention. To facilitate consideration and discussion, elements illustrated in FIGS. 6 and 7 which correspond to the elements described above with respect to FIGS. 3, 4, and 5 have been designated by corresponding reference numerals increased by one hundred. The embodiment of FIGS. 6 and 7 is constructed and designed for use in the same manner as the embodiment of FIGS. 3, 4, and 5, unless otherwise stated.

Referring now to FIGS. 6 and 7, an electrical plug blade 310 includes a blade portion 312 having a pad 322 embossed into each side thereof. To maintain a uniform thickness along the length of the pads 322, the electrical plug blade 310 has a tip 324 with an open, oval-shaped cross-section (as can be seen in the side elevational view of FIG. 6). A pilot hole 326, extending completely through the electrical plug blade 310, is provided near the tip 324 as a guide for the production die. A dimple 328 is located on each of the pads 322, near the end of each pad 322 opposite the tip 324, to add strength to each pad 322, such that if the pads 322 are compressed, they will not be crushed by the compression force.

The padded blade shown in FIGS. 6 and 7 has been designed as a range-style blade to be used in 30 to 60 ampere applications. The principal differences between the padded range-style blade of the present invention and padded blades of the prior art (which are used in 15 ampere applications) are that in the present invention, the blade portion 312 is longer and wider and the thickness of the blade portion 312 and the pads 322 may be varied relative to each other, such that the combined thickness does not exceed the maximum standard thickness of 0.100 inches. In addition, this embodiment can be constructed with a standard wire crimp or with a self-centering wire crimp similar to those described above in connection with FIGS. 2–5.

It will be understood that the embodiments described herein are merely exemplary and that a person skilled in the art may make variations and modifications without departing from the spirit and scope of the present invention. For instance, the shape of the centering nubs could be varied, provided they are constructed such that they slope downward toward the base of the wire cradle, allowing a stranded wire to be self-centered between the two nubs. Any such variations and modifications are intended to be included within the scope of the invention as defined in the appended claims.

What is claimed is:

1. An electrical plug blade, comprising:

a blade portion;

a wire cradle located at an end of said blade portion and having a base;

two outwardly extending crimp ears, one crimp ear on each side of said wire cradle; and centering means located in said base of said wire cradle for centering a wire in said wire cradle, said centering means including a pair of spaced nubs projecting above said base along longitudinal sides of said cradle and defining a depression therebetween for at least partially receiving a portion of a wire to be attached to said electrical plug blade.

2. An electrical plug blade according to claim 1, wherein each of said nubs is located adjacent to a corresponding one of said crimp ears.

3. An electrical plug blade, comprising:

a blade portion including a first side having a first thickness and a second side having a second thickness, said second side being located opposite said first side;

a first pad provided on an embossed section of said first side, said embossed section of said first side having a third thickness which is greater than said first thickness;

a second pad provided on an embossed section of said second side, said embossed section of said second side having a fourth thickness which is greater than said second thickness;

a tip located at one end of said blade portion adjacent said embossed sections, said tip having an oval-shaped cross section with a fifth thickness which is substantially the same as the sum of said third thickness and said fourth thickness;

a wire cradle located at an opposite end of said blade portion, said wire cradle having a base;

two outwardly extending crimp ears, one crimp ear on each side of said wire cradle; and centering means located in said base of said wire cradle for centering a wire in said wire cradle, said centering means including a pair of spaced nubs projecting above said base along longitudinal sides of said cradle and defining a depression therebetween for at least partially receiving a portion of a wire to be attached to said electrical plug blade.

4. An electrical plug blade according to claim 3, wherein each of said nubs is located adjacent to a corresponding one of said crimp ears.

5. An electrical plug blade according to claim 3, further comprising a pilot hole located near said tip and extending completely through said blade portion.

6. An electrical plug blade according to claim 3, further comprising a first dimple located on said first pad and extending toward said second pad; and a second dimple located on said second pad and extending toward said first paid, said first dimple and said second dimple maintaining a spacing between said first pad and said second pad.

7. An electrical plug blade for use in 30 to 60 ampere applications, comprising:

a blade portion including a first side having a first thickness and a second side having a second thickness, said second side being located opposite said first side;

a first pad provided on an embossed section of said first side, said embossed section of said first side having a third thickness which is greater than said first thickness;

a second pad provided on an embossed section of said second side, said embossed section of said second side having a fourth thickness which is greater than said second thickness;

a tip located at one end of said blade portion adjacent said embossed sections, said tip having an oval-shaped cross section with a fifth thickness which is substantially the same as the sum of said third thickness and said fourth thickness, said fifth thickness being no greater than 0.100 inches;

a wire cradle located at an opposite end of said blade portion, said wire cradle having a base;

two outwardly extending crimp ears, one crimp ear on each side of said wire cradle; and centering means located in said base of said wire cradle for centering a wire in said wire cradle, said centering means including a pair of spaced nubs projecting above said base along longitudinal sides of said cradle and defining a depression therebetween for at least partially receiving a portion of a wire to be attached to said electrical plug blade.

8. An electrical plug blade according to claim 7, wherein the thickness of said blade portion and said first and said second pads can be varied relative to each other such that the sum of said third thickness and said fourth thickness is no greater than 0.100 inches.

9. An electrical plug blade according to claim 7, further comprising a pilot hole located near said tip and extending completely through said blade portion.

10. An electrical plug blade according to claim 7, further comprising a first dimple located on said first pad and extending toward said second pad; and a second dimple located on said second pad and extending toward said first pad, said first dimple and said second dimple maintaining a spacing between said first pad and said second pad.

11. An electrical plug blade according to claim 7, wherein said centering means centers a stranded wire in said wire cradle.

12. An electrical plug blade according to claim 7, wherein each of said nubs is located adjacent to a corresponding one of said crimp ears.

* * * * *